US007119744B2

(12) United States Patent
Theobold et al.

(10) Patent No.: US 7,119,744 B2
(45) Date of Patent: Oct. 10, 2006

(54) CONFIGURABLE ANTENNA FOR A WIRELESS ACCESS POINT

(75) Inventors: David M. Theobold, Akron, OH (US); Michael E. Lewis, Hartville, OH (US)

(73) Assignee: Cisco Technology, Inc., San Jose, CA (US)

( * ) Notice: Subject to any disclaimer, the term of this patent is extended or adjusted under 35 U.S.C. 154(b) by 88 days.

(21) Appl. No.: 10/760,340

(22) Filed: Jan. 20, 2004

(65) Prior Publication Data

US 2005/0156794 A1 Jul. 21, 2005

(51) Int. Cl.
*H01Q 1/38* (2006.01)

(52) U.S. Cl. ..... 343/700 MS; 343/876

(58) Field of Classification Search ..... 343/700 MS, 343/712, 372, 815, 816, 817, 876, 702; 455/562.1, 455/561

See application file for complete search history.

(56) References Cited

U.S. PATENT DOCUMENTS 5,990,837 A * 11/1999 Norris et al. ..... 343/701
6,339,404 B1 * 1/2002 Johnson et al. ..... 343/794
6,697,641 B1 * 2/2004 Shapira ..... 455/562.1
6,828,938 B1 * 12/2004 Tran ..... 343/700 MS

* cited by examiner

*Primary Examiner*—Tuyet Vo
*Assistant Examiner*—Jimmy Vu
(74) *Attorney, Agent, or Firm*—Tucker Ellis & West LLP

(57) ABSTRACT

The difficulties and drawbacks of the previous-type systems are overcome by the present antenna system, alone and in combination with a wireless access point. The present antenna system includes a plurality of antenna elements for providing a respective plurality of communications signals over a wireless channel. An isolating structure is provided, selectively positioned with respect to the antenna elements, for selective varying signal isolation between the respective antenna elements. In this way, the present system is selectable between a high-throughput/short-range configuration and a low-throughput/long-range configuration.

26 Claims, 4 Drawing Sheets

CONFIGURABLE ANTENNA FOR A WIRELESS ACCESS POINT

BACKGROUND OF THE RELATED ART

The present invention is directed to the field of wireless networking, particularly as applied to different types of wireless networks having different implementation objectives. In a typical local area network (LAN), it is necessary for users to make a "hardware" network connection in which a client device (e.g. a personal computer system) is connected to a wire, which in turn is plugged into a socket for accessing a wired network. However, in using a wired LAN connection, a client device must be operated from a fixed position. This may be acceptable when using a stationary desktop terminal. However, if a laptop or handheld computer is used, it is necessary for the user to disconnect from the network when moving from place to place. Also, it cannot be assumed that a new location will have a network socket for reconnecting. This can be a significant limitation in enviromnents where it is important for a user to maintain a constant network connection.

Wireless local area networks (WLAN's) are becoming an increasingly popular alternative to a common wired LAN. In a WLAN, users make a wireless connection to the network. In this way, a user can move from location to location with a client device within a specified WLAN coverage area and maintain a constant connection to the network. This is highly advantageous since it enables the user to set up anywhere within a coverage area without requiring access to a network port. It also saves the user the inconvenience of fumbling with wires and plugs, while insuring continuous network connectivity for downloads and communications.

A client device can include a radio card having suitable radio circuitry for converting between electronic signals, internal to the device, and radio signals. The radio card also includes an antenna arrangement for exchanging radio signals with a wireless access point (AP). A typical AP also includes an antenna arrangement for exchanging radio signals with the client device, and radio circuitry for converting between the exchanged radio signals and electronic signals suitable to the wired network. Typically, such network signals are in accordance with the Ethernet protocol as specified in the IEEE 802.3 standard. Additionally, the radio signals are typically in accordance with the IEEE 802.11 wireless protocol.

In the marketplace, there are various WLAN implementations to satisfy various needs. Generally, a particular market implementation may require high-throughput connectivity where another may require extended radio range at the expense of throughput. For example, in the enterprise market, there may be a number of mobile clients such as laptop systems in a relatively small area, e.g. a conference room. In such an enterprise rollout, each mobile client might require high throughput, possibly for downloading audio-visual multimedia files. In such a case the clients would all be within relatively close proximity to the AP, so throughput would not be penalized by excessive distance from the AP. On the other hand, in a vertical market, wireless communications would be required over a large physical area, such as a warehouse or a large retail establishment, such as a department store. Low data rate wireless mobile client systems such as hand-held bar code scanner units would be employed for scanning inventory items and other such purposes, at locations physically remote from the AP. Hence in this market, low-throughput data is transferred over a large geographical distance, so extended signal range is required as opposed to high capacity.

Previously, it has been common to sell specific-type AP systems for each specific application: long range vs. high capacity. This has required manufacturers to produce different systems for each specific market. Providing distinct types of AP's contributes to overall expense, with manufacture, packaging, inventory, marketing, etc. Also, such systems do not offer flexibility to end-users having changing needs, where either throughput or range must be increased in a particular rollout at a later time after the original installation. Such systems are also not optimal in "hybrid" rollouts where throughput may be required in one portion of the coverage area and range is required in another. In these instances, the end-users would be required to add additional equipment to their WLAN, resulting in additional expense.

SUMMARY OF THE PRESENT EMBODIMENTS

The difficulties and drawbacks of the previous-type systems are overcome by the present antenna system, alone and in combination with a wireless access point. The present antenna system includes a plurality of antenna elements for providing a respective plurality of communications signals over a wireless channel. An isolating structure is provided, selectively positioned with respect to the antenna elements, for selectively varying signal isolation between the respective antenna elements. In this way, the present system is selectable between a high-throughput/short-range configuration and a low-throughput/long-range configuration.

As will be realized, the present system is capable of other and different embodiments and its several details are capable of modifications in various respects, all without departing from the invention. Accordingly, the drawings and descriptions are to be regarded as illustrative and not restrictive.

DETAILED DESCRIPTION OF THE PRESENT EMBODIMENTS

The present antenna system can be adapted to accommodate a variety of different design requirements, including increased signal range, coherent combining, and multiple-input/multiple-output (MIMO), where various of these requirements can be met simultaneously or by reconfiguration of the antenna system, as will be described hereinbelow. In contrast to manufacturing a variety of access point systems, each tailored to a particular set of requirements, the present system enables very different and even mutually exclusive design goals to be achieved in one architecture, greatly enhancing the versatility of the product.

Figure 1A:
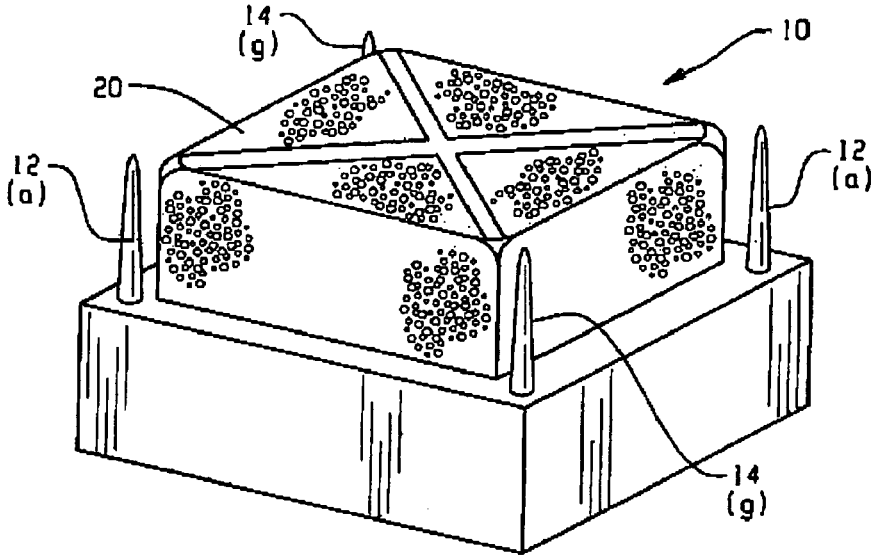
FIGS. 1A and 1B are oblique views showing selective positioning of an isolating structure with an antenna system in a wireless access point in accordance with a first embodiment.

The present embodiments will now be described with respect to the figures, where like reference numerals are understood to correspond with like elements. As shown in FIG. 1A, the present antenna system 10 includes a plurality of antenna elements 12, 14 for providing a respective plurality of communications signals over a wireless channel. As shown, a first pair of antennas 12 may be provided to operate over the 802.11(a) channel and a second pair 14 may be provided to operate over the 802.11(g) channel. A selectively configurable passive antenna structure 20, preferably an isolating structure, is provided to be selectively positioned with respect to the antenna elements 12, 14. The isolating structure 20 selectively varies signal isolation between the respective antenna elements, so as to permit the antenna system 10 to operate in a variety of modes. A plurality of such selectively configurable passive antenna structures 20 can be provided for creating any desired isolation between any number of antennas.

These passive structures 20 can preferably be selectively configured without changing the electrical connectivity or the positions of the various antenna elements 12, 14 themselves. The end user can select any desired configuration. In a preferred embodiment, the present isolating structures 20 are removable structures, each preferably selectively received in a socket co-located in a suitable position with respect to the antenna elements. However, other selective configuration approaches can also be contemplated, as discussed hereinbelow. The present passive antenna structure 20 is preferably composed of a material for providing radio signal isolation, such as absorbing foam 22 or metal reflectors 24, or a suitable combination thereof, to result in an absorbing/reflecting structure. The passive antenna structure 20 can optionally be enclosed by a shell, possibly made of plastic or some other appropriate material, to provide protection to the structure and also a decorative appearance.

The present antenna system 10 is preferably contemplated as being included in a wireless access point 30 used with a WLAN, and including radio circuitry 32 for exchanging an electronic network signal with a wireless signal. The plurality of antenna elements employed with the present system can be used to provide wireless communications over a plurality of wireless channels. The wireless channels can optionally be in accordance with the IEEE 802.11 wireless networking specifications. Specifically, the wireless channels can be optionally selected from a group including 2.4 GHz and 5 GHz wireless bands. However, it should be appreciated that the present antenna system can be adapted to embodiments in any other type system without departing from the invention.

Figure 2A:
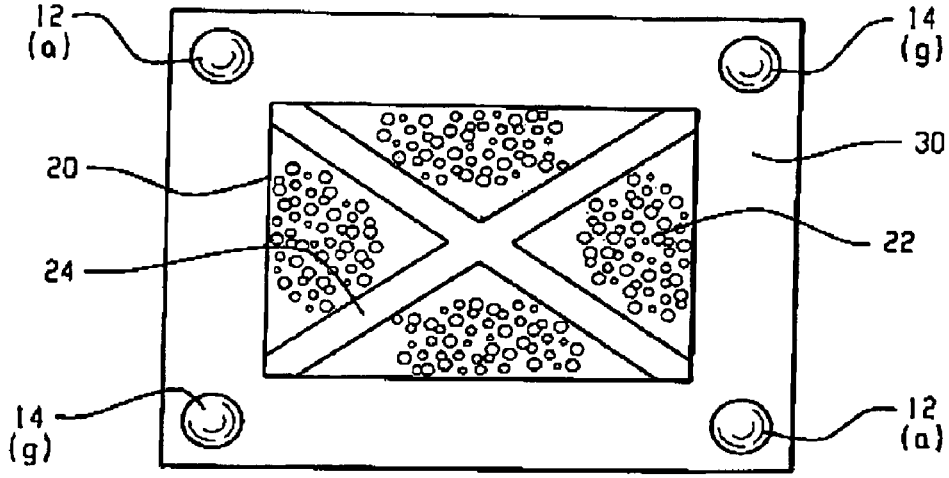
FIGS. 2A and 2B are top views of antenna systems used with wireless access points in accordance with alternate embodiments.
Figure 2B:
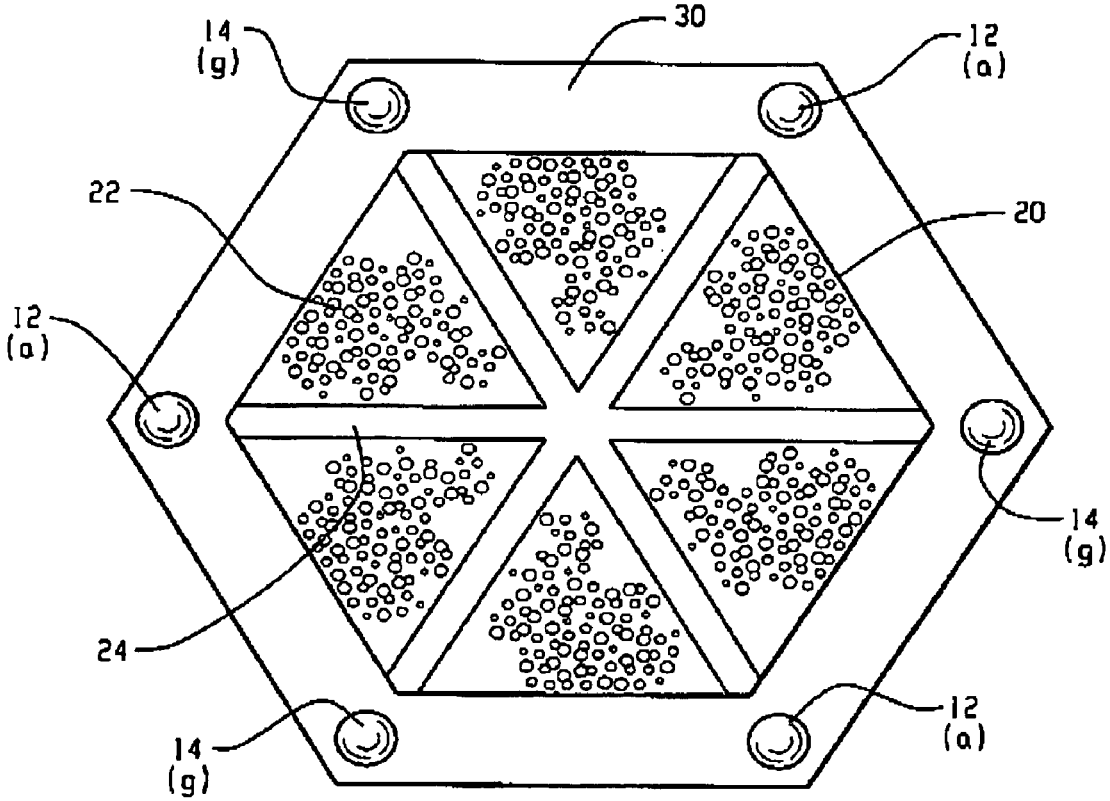

In one implementation, as shown in FIG. 1A, the isolating structure 20 is adapted to selectively vary signal isolation so as to switch between a sectorized, multiple access point antenna configuration, and an antenna array configuration. In an implementation where a large amount of throughput is desired, as in a conference room, conference center, or other public place, it would be efficient to co-locate two or more APs, operating on different channels, in a single AP enclosure. Even though the APs are on separate channels the antennas need to be isolated by more that the isolation that physical separation provides. In such an application, signal isolation between monopole or dipole antennas 12, 14 can be obtained by locating the isolating structures 20 in the interstitial spaces. Such a configuration can be used for both 802.11g or 802.11a wireless LAN systems, or any other multichannel omni-directional communications system for that matter. This signal isolation results in a "sectorized" antenna system in which each antenna and its associated transmitter and receiver covers a hemispherical area, together providing 360-degree coverage for each non-interfering channel. In this way, such a sectorized antenna system services wireless clients in a particular sector, e.g. mobile laptops in a specific area of a conference room. Such a configuration is very effective at providing large quantities of bandwidth to mobile clients in a specific service area. As shown in FIGS. 2A and 2B, the present system can include an access point 30 with four or six antennas 12, 14, or any other suitable number such as would be contemplated.

Figure 1B:
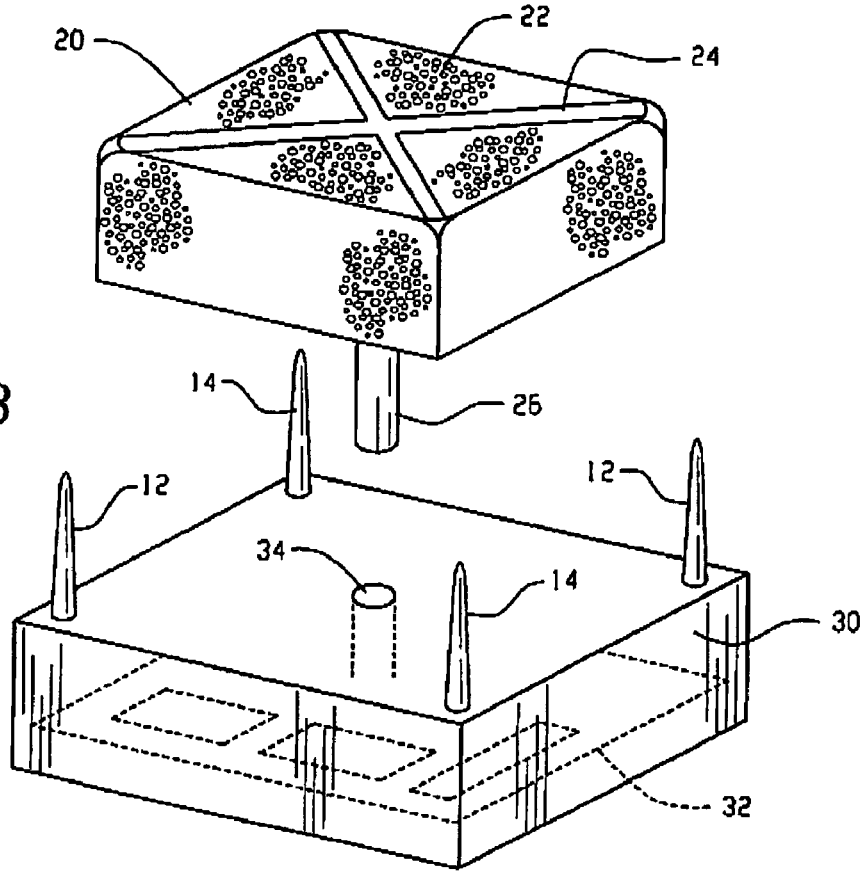

An alternatively selected configuration is shown in FIG. 1B in which the isolating structure 20 is removed. In this configuration, the signals of two or more 802.11(a) antennas 12 (and likewise two or more 802.11(g) antennas 14) can be combined to operate in a "range extension" mode that would enable the operation of low-throughput mobile devices over a long distance from the access point 30, e.g. wireless hand-held bar code readers in a warehouse or large retail establishment such as a department store. The signals of the respective antennas 12, 14 can be combined by employing a generalized coherent combining technique such as maximum-ratio-combining (MRC). Two-antenna MIMO could also be implemented. Also, phase combining could be implemented to obtain a directional antenna array in which directional beams and nulls are created and the beams "steered" toward mobile clients. Of course, it is to be appreciated that any method employing a plurality of antennas on transmit and receive could be implemented.

With the present embodiments, the antenna elements do not need to be repositioned. Switching can be accomplished within the AP 30 to detect the desired configuration of antenna combining. For example, as shown in FIG. 1B, a plastic pin 26 can extend from the isolating structure into the AP housing, and make contact with a solid-state, mechanical, or optical switch 34 to detect the presence or absence of the isolation structure 20. The reconfiguration is accomplished by simply removing or respectively inserting the isolating structure 20 between the antennas 12, 14. The present approach is not limited to the embodiments presented above; instead many other configurations would be possible. For example, single absorbers could be located between individual antenna pairs. Reflecting plates or vanes might be used to accomplish the same functionality for diversity antenna pairs. Combinations of the two can be contemplated.

Figure 3A:
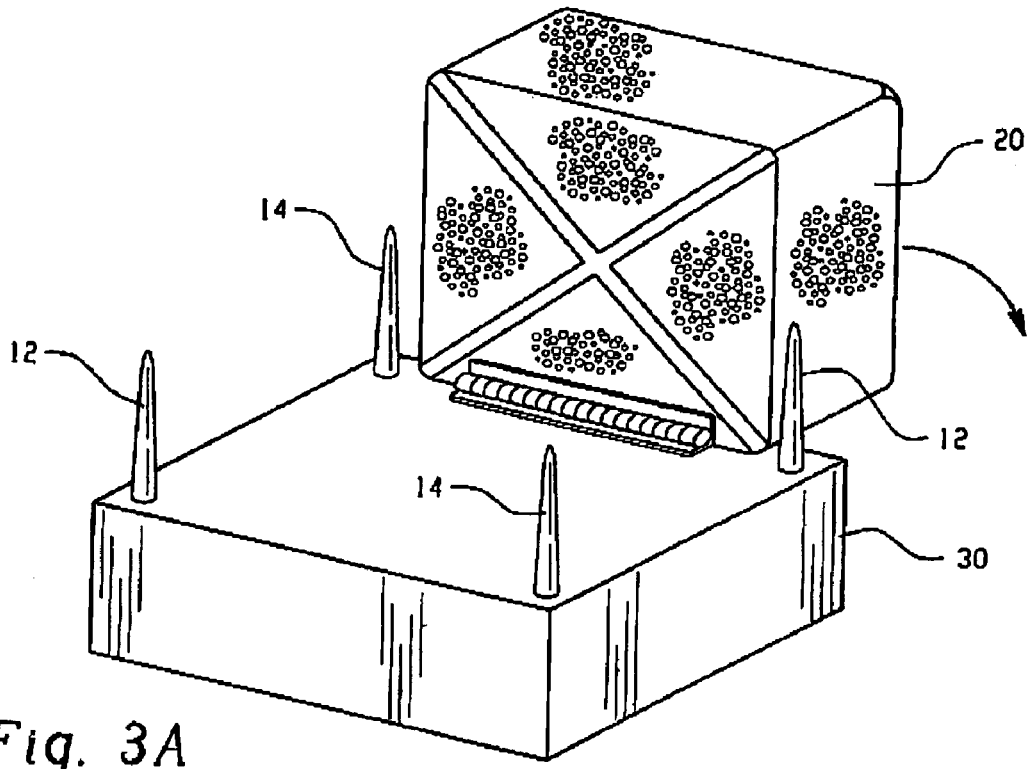
FIGS. 3A and 3B are oblique views showing alternate embodiments for selective positioning of an isolating structure with respect to an antenna system in a wireless access point.
Figure 3B:
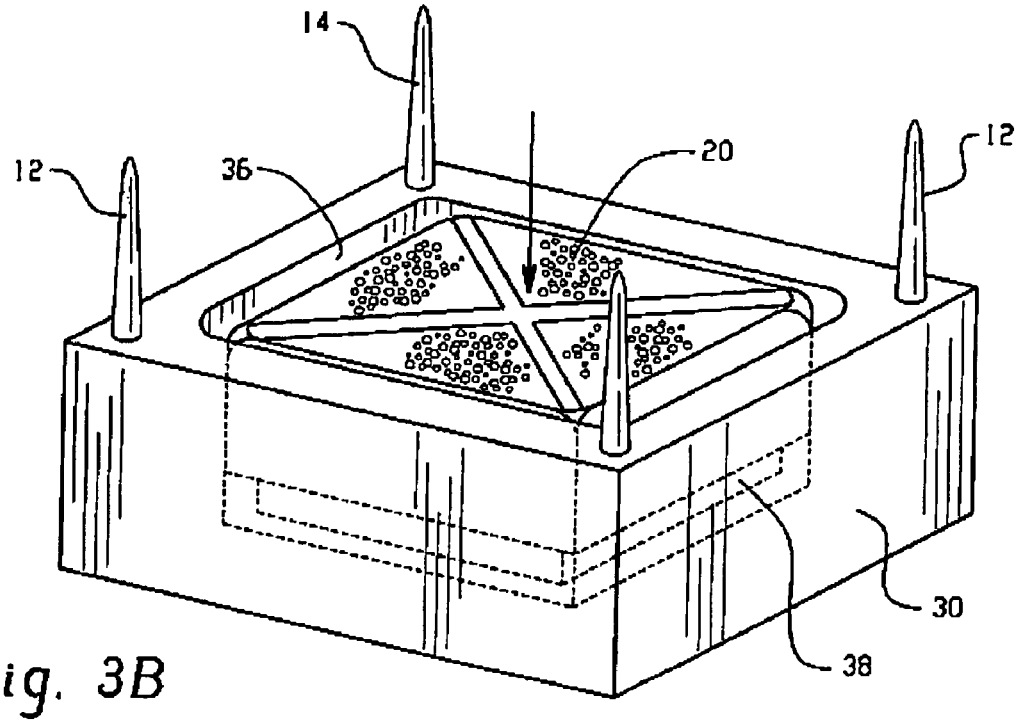

Other embodiments might be considered for obtaining a desired isolation configuration, as an alternative to the removable structure disclosed above. The isolating structure 20 can be a displaceable structure, for selective displacement between an isolating position and a non-isolating position. As shown in FIG. 3A, the isolating structure 20 can be hinged so as to pivot between isolating and non-isolating positions. Alternatively, as shown in FIG. 3B, the isolating structure 20 can be selectively retained inside a cavity 36, so that the isolating structure 20 is in the non-isolating position when stowed in the cavity 36, and is in the isolating position when not stowed in the cavity. This can be accomplished by using a displacement element 38 within the cavity. The displacement element 38 can be a spring-loaded device within the cavity, to selectively retain the isolating structure 20 either inside or outside the cavity. The displacement element 38 may alternatively be a motor driven element, or an element for displacement in any other such manner, all without departing from the invention.

Figure 4A:
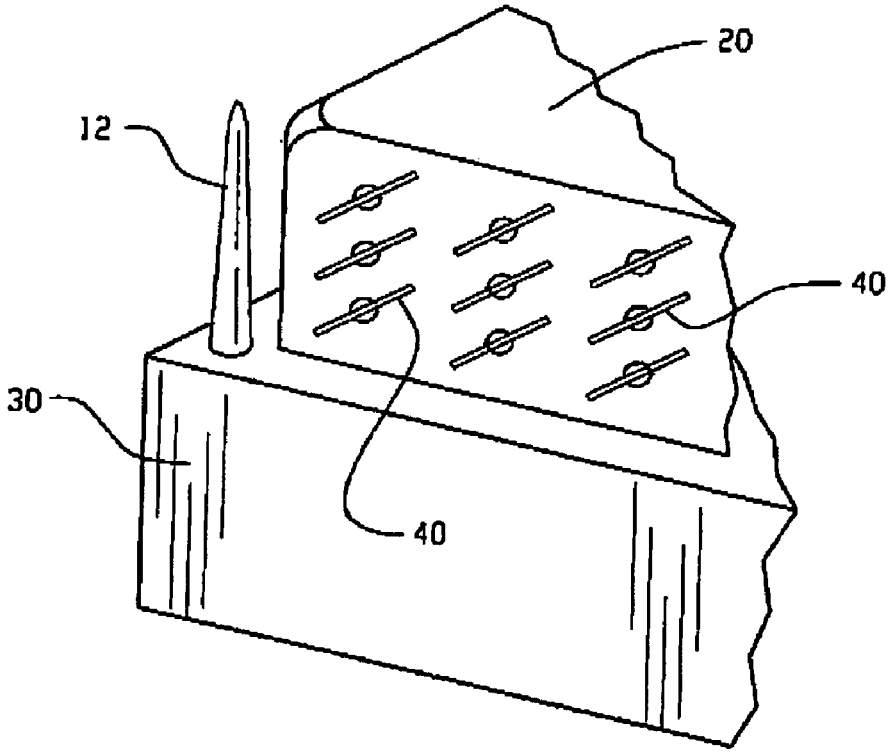
FIGS. 4A and 4B are oblique views showing further alternate embodiments of an isolating structure used with an antenna system.
Figure 4B:
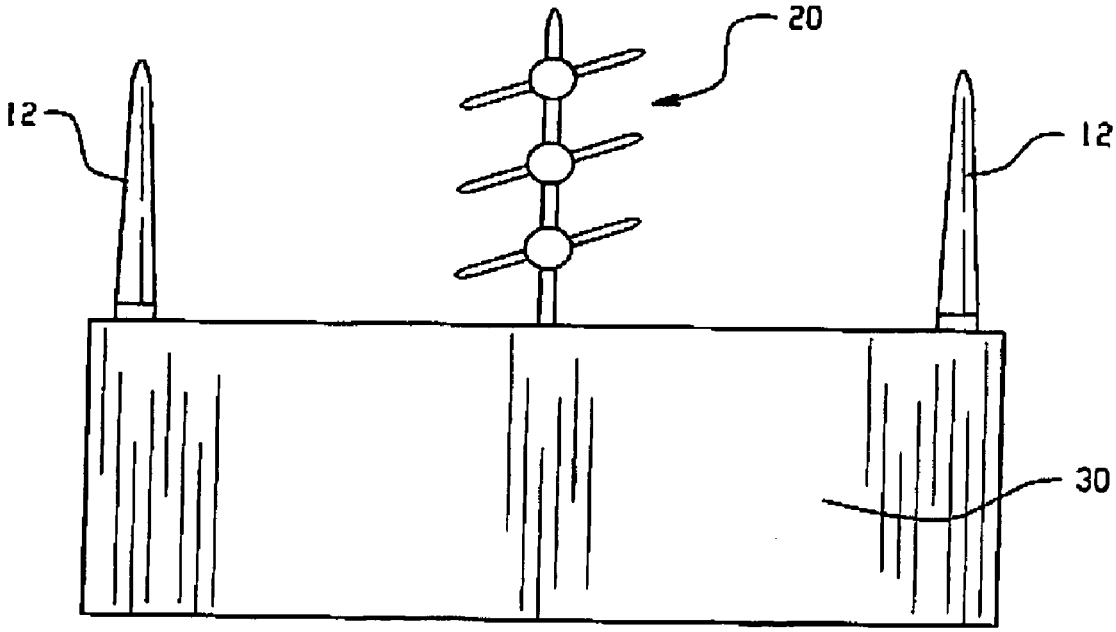

In another embodiment, as shown in FIG. 4A, the isolating structure 20 is formed of a material having displaceable elements 40 at a sub-macroscopic level, adapted to select between isolating and non-isolating polarization states. This may be obtained using a material having a displaceable property upon application of an external force, e.g. an electric or magnetic field. This can also be obtained using nanotechnology, such as with Micro Electro-Mechanical Systems (MEMS). In still another embodiment, as shown in FIG. 4B, the isolating structure 20 is a louvered arrangement, adapted to select between a closed, isolating position and an open, non-isolating position.

With the present system, a removable absorbing/reflecting isolating structure can be used that allows one to achieve very different design goals in a single AP, thereby providing a uniquely versatile single product that supports the function of a variety of different previous-type systems. By providing a selectable isolating element, the present antenna system can operate in modes having widely differing requirements. The present system permits the broadest possible range of antenna operating modes in a simple and inexpensive package. The present system also provides configuration detection and can be easily reconfigured by the end user.

As described hereinabove, the present system solves many problems associated with previous type systems. However, it will be appreciated that various changes in the details, materials and arrangements of parts which have been herein described and illustrated in order to explain the nature of the present system may be made by those skilled in the area within the principle and scope of the embodiments will be expressed in the appended claims.

We claim:

1. An antenna system, comprising:

a plurality of antenna elements for providing a respective plurality of communications signals over a wireless channel; and an isolating structure, selectively positioned with respect to the antenna elements, for selective varying signal isolation between the respective antenna elements;

wherein the isolating structure is adapted to selectively vary signal isolation so as to switch between a sectorized antenna configuration and an antenna array configuration; and wherein the isolating structure is a removable structure, selectively received in a socket co-located with respect to the antenna elements.

2. An antenna system, comprising:

a plurality of antenna elements for providing a respective plurality of communications signals over a wireless channel; and an isolating structure, selectively positioned with respect to the antenna elements, for selective varying signal isolation between the respective antenna elements;

wherein the isolating structure is adapted to selectively vary signal isolation so as to switch between a sectorized antenna configuration and an antenna array configuration; and wherein the isolating structure is a displaceable structure, for selective displacement between an isolating position and a non-isolating position.

3. The antenna system of claim 2 wherein the isolating structure is hinged so as to pivot between isolating and non-isolating positions.

4. The antenna structure of claim 2 wherein the isolating structure is adapted to be selectively retained inside a cavity, wherein the isolating structure is in the non-isolating position when stowed in the cavity, and is in the isolating position when not stowed in the cavity.

5. The antenna structure of claim 4 wherein the isolating structure is spring-loaded to be selectively retained inside the cavity.

6. The antenna system of claim 2 wherein the isolating structure is formed of a material having displaceable elements at a sub-macroscopic level, adapted to select between isolating and non-isolating polarization states.

7. The antenna system of claim 2 wherein the isolating structure is a louvered arrangement, adapted to select between a closed, isolating position and an open, non-isolating position.

8. The antenna system of claim 1 wherein the plurality of antenna elements provide wireless communications over a plurality of wireless channels.

9. The antenna system of claim 8 wherein at least one of the wireless channels is selected from a group including 2.4 GHz and and 5 GHz wireless bands.

10. A wireless access point, comprising:

radio circuitry for exchanging an electronic network signal with a wireless signal;

an antenna system for sending and receiving wireless signals with a mobile client coupled to the radio circuitry, the antenna system further comprising:

a plurality of antenna elements for providing a respective plurality of communications signals over a wireless channel; and an isolating structure, selectively positioned with respect to the antenna elements, for selective varying signal isolation between the respective antenna elements;

wherein the isolating structure is adapted to selectively vary signal isolation so as to switch between a sectorized antenna configuration and an antenna array configuration; and wherein the isolating structure is a removable structure, selectively received in a socket co-located with respect to the antenna elements.

11. The wireless access point of claim 10 wherein the plurality of antenna elements provide wireless communications over a plurality of wireless channels.

12. A wireless access point, comprising:

radio circuitry for exchanging an electronic network signal with a wireless signal;

an antenna system for sending and receiving wireless signals with a mobile client coupled to the radio circuitry, the antenna system further comprising:

a plurality of antenna elements for providing a respective plurality of communications signals over a wireless channel; and an isolating structure, selectively positioned with respect to the antenna elements, for selective varying signal isolation between the respective antenna elements;

wherein the isolating structure is adapted to selectively vary signal isolation so as to switch between a sectorized antenna configuration and an antenna array configuration; and wherein the isolating structure is a displaceable structure, for selective displacement between an isolating position and a non-isolating position.

13. The wireless access point of claim 12 wherein the isolating structure is hinged so as to pivot between isolating and non-isolating positions.

14. The wireless access point of claim 12 wherein the isolating structure is adapted to be selectively retained inside a cavity, wherein the isolating structure is in the non-isolating position when stowed in the cavity, and is in the isolating position when not stowed in the cavity.

15. The wireless access point of claim 14 wherein the isolating structure is spring-loaded to be selectively retained inside the cavity.

16. The wireless access point of claim 12 wherein the isolating structure is formed of a material having displaceable elements at a sub-macroscopic level, adapted to select between isolating and non-isolating polarization states.

17. The wireless access point of claim 12 wherein the isolating structure is a louvered arrangement, adapted to select between a closed, isolating position and an open, non-isolating position.

18. The wireless access point of claim 11 wherein at least one of the wireless channels is selected from a group including 2.4 GHz and and 5 GHz wireless bands.

19. An antenna system, comprising:

a mean for providing a respective plurality of communications signals over a wireless channel;

a means for selective varying signal isolation selectively positioned with respect to the means for providing a respective plurality of communications signals over a wireless channel;

wherein the means for selective varying signal isolation is adapted to selectively vary signal isolation so as to switch between a sectorized antenna configuration and an antenna array configuration; and wherein the means for selective varying signal isolation is displaceable for selective displacement between an isolating position and a non-isolating position.

20. The antenna system of claim 19 wherein the means for selective varying signal isolation is hinged so as to pivot between isolating and non-isolating positions.

21. The antenna structure of claim 19 wherein the means for selective varying signal isolation is adapted to be selectively retained inside a cavity, wherein the means for selective varying signal isolation is in the non-isolating position when stowed in the cavity, and is in the isolating position when not stowed in the cavity.

22. The antenna stricture of claim 19 wherein the means for selective varying signal isolation is spring-loaded to be selectively retained inside the cavity.

23. The antenna system of claim 19 wherein the means for selective varying signal isolation is formed of a material having displaceable elements at a sub-macroscopic level, adapted to select between isolating and non-isolating polarization states.

24. The antenna system of claim 19 wherein the means for selective varying signal isolation is a louvered arrangement, adapted to select between a closed, isolating position and an open, non-isolating position.

25. The antenna system of claim 19, wherein the means for providing a respective plurality of communications signals over a wireless channel provides wireless communications over a plurality of wireless channels.

26. The antenna system of claim 25, wherein at least one of the wireless channels is selected from the group consisting of 2.4 GHz and 5 GHz wireless bands.

* * * * *